US005264996A

United States Patent [19]

Bele, Jr. et al.

[11] Patent Number: 5,264,996

[45] Date of Patent: Nov. 23, 1993

[54] COLLAPSIBLE HOLIDAY LUMINARY

[76] Inventors: Anthony J. Bele, Jr., 1831 Meadows Glen La., Winston-Salem, N.C. 27127; Peter A. Kazmar, 3470 Tanglebrook Trail, Clemmons, N.C. 27012

[21] Appl. No.: 837,745

[22] Filed: Feb. 19, 1992

[51] Int. Cl.[5] ..... F21L 19/00

[52] U.S. Cl. ..... 362/162; 362/163; D26/11; 493/950; 229/162; 229/113; 229/108.1

[58] Field of Search ..... 362/161, 162, 163, 352; 431/191; D26/11; 493/950, 905, 901; 229/162, 113, 108.1

[56] References Cited

U.S. PATENT DOCUMENTS

| | | | |
|---|---|---|---|
| 1,630,497 | 5/1927 | Morris | 229/162 |
| 2,643,815 | 6/1953 | Komeo | 229/113 |
| 4,441,614 | 4/1984 | Gulliver | 229/162 |
| 4,778,392 | 10/1988 | Mitchell | 229/113 |
| 4,907,140 | 3/1990 | Overstreet | 229/162 |
| 5,060,853 | 10/1991 | Gulliver et al. | 493/905 |

FOREIGN PATENT DOCUMENTS

| | | | |
|---|---|---|---|
| 427845 | 5/1935 | United Kingdom | 229/113 |
| 428869 | 5/1935 | United Kingdom | 229/113 |

*Primary Examiner*—Carroll B. Dority

[57] ABSTRACT

A flat blank of stiff, foldable paper or paperboard is folded to form a multi-sided luminary with a top in the shape of truncated, open top pyramid. One end of each of the sides includes a trapezoidal panel extending therefrom, the longest base of the trapezoidal panel being substantially the same length as and foldably secured to the adjacent end of the corresponding side. Each of the sides of the luminary include one or more cutouts giving the appearance of a seasonal symbol. The bottom is closed and, in a preferred embodiment, includes a seat therein for retaining a light source such as a candle.

5 Claims, 3 Drawing Sheets

COLLAPSIBLE HOLIDAY LUMINARY

BACKGROUND AND SUMMARY OF THE INVENTION

The present invention relates generally to folding decorative luminaries and, more particularly, to a luminary that is formed of foldable paperboard and, when erected.

The use of luminaries has increased substantially in recent years. Luminaries are used during holiday seasons to outline walks or curbs. Generally, in the usual form, luminaries are simply paper bags with sand in the bottom thereof. The sand serves to temporarily hold a candle in place and also as ballast to hold the bag upright at a prescribed location. During evening hours, the candle is lit, and the light shines through the translucent bag to give a warm decorative effect. Usually such luminaries may be used only once and then must be discarded.

There have been very few attempts to improve such outdoor luminaries, or to provide a luminary that can be repeatedly used for extended periods of time as, for example, nightly throughout an entire holiday season. One example of a collapsible lantern is illustrated in the Overstreet U.S. Pat. No. 4,907,140. The Overstreet lantern is not in the configuration of a conventional luminary, but is in a shape which has a top portion formed in an open gable configuration. So formed, the Overstreet lantern gives the appearance of a small house with openings in opposed sides thereof. The gable configuration resembles a conventional roof top. The only means for securing the candle on the floor of the Overstreet reference is by using wax drippings from the candle itself.

The present invention is intended to provide the purchaser with relatively inexpensive luminaries of relatively conventional shape. Such luminaries may be shipped, stored, and marketed in collapsed, flat form, then easily folded and erected by the purchaser prior to use. The luminaries are treated for moisture resistance. As such, they may be used repeatedly on several occasions, even up to an entire holiday season.

In general, the luminary of the present invention is collapsible and, when displayed, exhibits substantially the same silhouette from all sides. In a preferred embodiment, the floor of the luminary includes a seat for retaining a candle.

In order to form a luminary having substantially the same silhouette from all sides, the upper end of each side panel includes a trapezoidal panel extending therefrom, the longest base of the trapezoidal panel being substantially the same length and foldably secured to the adjacent end of the adjacent upper end of the side panel. The trapezoidal panels include some type of attaching means along the non-parallel sides so that, when connected, the top has the appearance of a truncated, open top pyramid.

Each of the side panels includes one or more cutouts therein which give the appearance of some seasonal symbol as the light from the candle shines through. The cutouts may either be open, or have some type of transparent or translucent plain or colored paper or film thereover.

Accordingly, one aspect of the present invention is to provide a collapsible holiday luminary which, when displayed, has substantially the same silhouette from all sides.

Another aspect of the present invention is to provide an integral folding blank for forming the luminary of the type described.

Another aspect of the present invention is to provide a luminary of the type described in which the top has the appearance of a truncated, open top pyramid.

Still another aspect of the present invention is to provide a collapsible luminary that may be repeatedly used on several occasions.

These and other aspects of the present invention will be more clearly understood after a review of the following description of the preferred embodiment of the invention, when considered with the accompanying drawings in which.

DESCRIPTION OF THE PREFERRED EMBODIMENT

Figure 2:
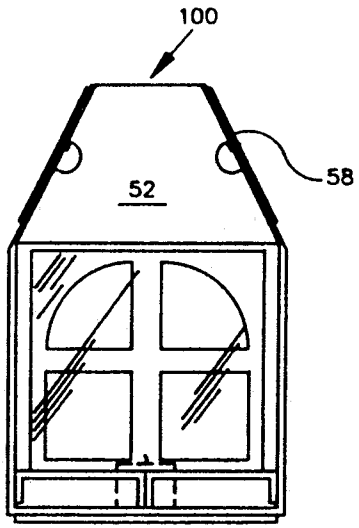
FIG. 2 is a vertical sectional view taken substantially along lines 2—2 of FIG. 1.
Figure 3:
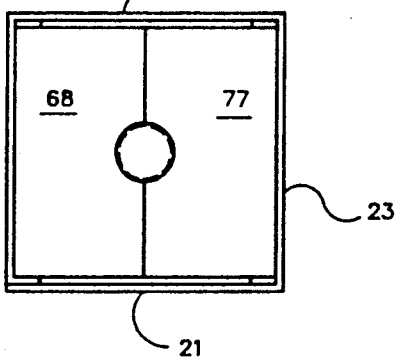
FIG. 3 is a horizontal sectional view taken substantially along lines 3—3 of FIG. 1.
Figure 1:
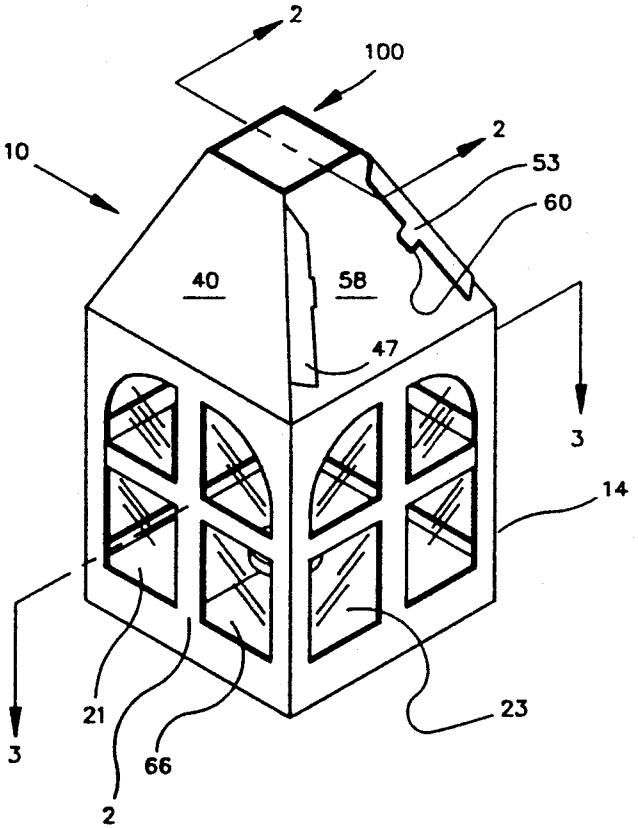
FIG. 1 is a perspective view of a luminary illustrating the features of the present invention, shown in the erected position.

Referring now to the drawings in general and to FIG. 1 in particular, it will be understood that the illustrations are for the purpose of describing a preferred embodiment of the invention and are not intended to limit the invention hereto. As best seen in FIG. 1, the luminary 10, in the erect position, includes a plurality of side panels 12,14,16,18. Each side panel includes one or more cutouts 21,23,25,27 to form a holiday or seasonal symbol, i.e., Christmas trees, angels, church windows, stars, hearts, jack-o-lanterns, etc. Extending upwardly from the upper end of side panels 12,14,16,18 (see FIG. 4) are a plurality of trapezoidal shaped panels 40,48,52,58. A means for closing the trapezoidal panels includes a plurality of tabbed flaps, as exemplified in FIG. 1 by flaps 47,53. Each flap 47,53 includes a tab **47*a*,54 which is insertable into a slot 59,60 in an adjacent trapezoidal panel. When erected, this forms a four-sided object with a trapezoidal upper portion having an open top 100 for the escape of smoke therefrom. The luminary 10 also includes a floor 66** which will be described hereafter.

Figure 4:
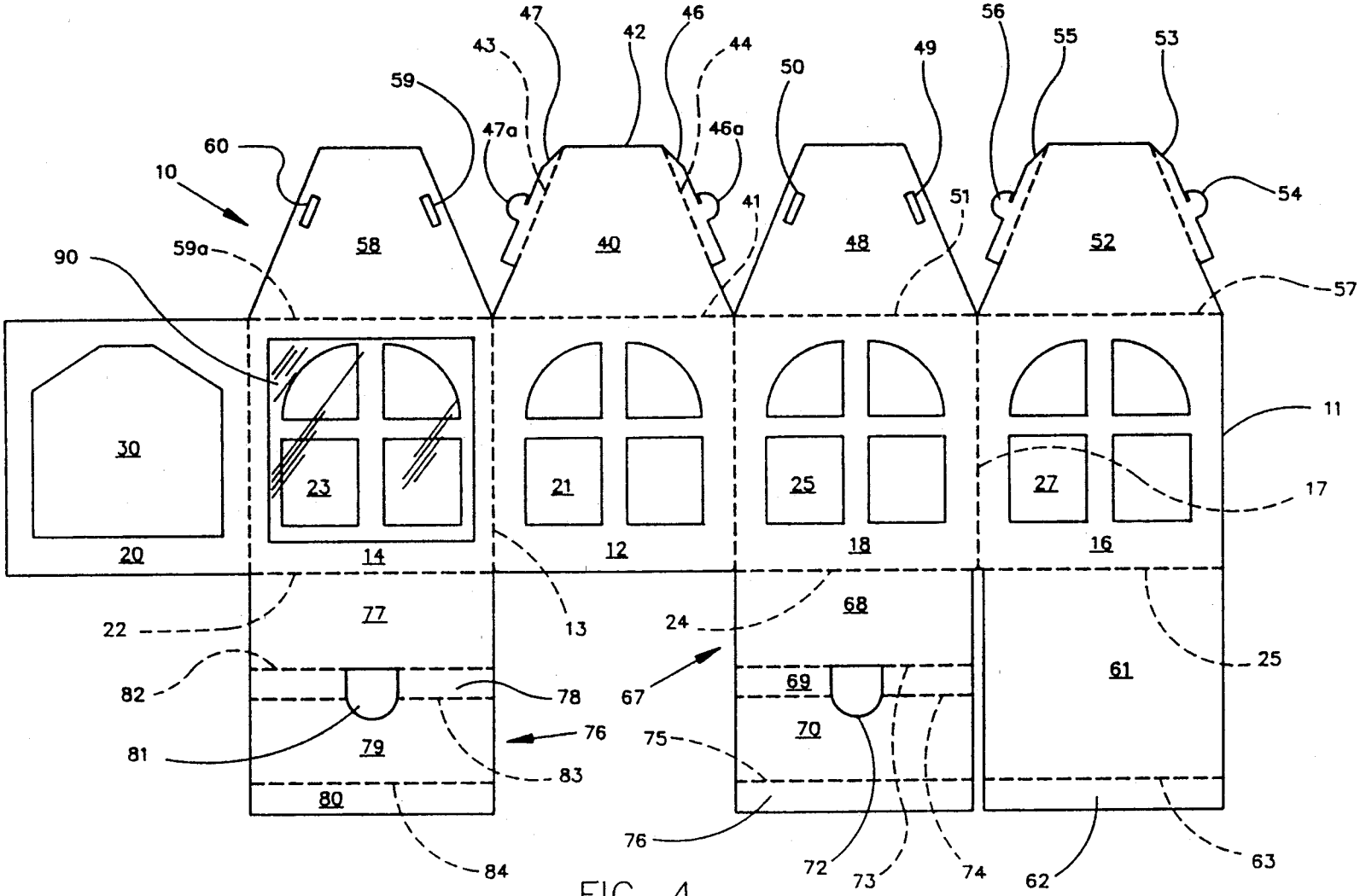
FIG. 4 is a plan view looking at the inner surface of a blank of foldable sheet material from which the luminary of the present invention is formed.

Turning now to FIG. 4, there is illustrated the blank from which the luminary 10 is formed. First of all, the blank is of a stiff paperboard or corrugated cardboard configuration which is treated with a combination clay and polymeric coating on at least the outer surface for weather resistance and with a flame retardant on at least the inner surface. The blank includes a plurality of side panels 12,14,16,18,20. As the description proceeds hereinafter, these panels will be referred to from right to left as the first side panel through the fifth side panel. Thus, the first side panel is panel 16, the second side panel is panel 18, the third side panel is panel 12, the fourth side panel is panel 14, and the fifth side panel is panel 20.

The first side panel (panel 16) and the second side panel (side panel 18) are connected by a scored fold line 17. Side panel 16 also includes a plurality of cutouts 27 which provide a seasonal symbol. A trapezoidal panel 52 extends upwardly from side panel 16 and is connected thereto by fold line 57. Trapezoidal panel includes a pair of side side flaps 53,55, each of which includes a foldable tab 54,56 attached thereto. Bottom wall 61 forms a lower closure member and is separated from side panel 16 by fold line 25. Bottom wall 61 terminates n a closure flap 62 which is connected to bottom wall 61 by a fold line 63.

Similarly, side panel 12 (the third side panel) is separated from side panel 18 by fold line 15 and similarly from side panel 14 by fold line 13. Side panel 12 includes a plurality of cutouts 23 which are substantially identical to the cutouts 27 in side panel 16. Trapezoidal panel 40 extends upwardly from side panel 12 and is separated therefrom by fold line 41. As best illustrated with reference to side panel 12, trapezoidal panel 40 includes a longer base 41 (which also serves as the fold line) and a shorter base 42. The non-parallel sides 43,44 of trapezoidal panel 40 carry closure flaps 46,47, each of which includes a foldable tab **46*a*,47*a* foldably attached thereto. Each of the trapezoidal panels 40,48,52,58 are formed of similar trapezoidal shapes, although trapezoidal panels 48,58 include slots 49,50,59,60 therein rather than closure panels. Notice also that side panel 12 has no flap extending downward therefrom and merely terminates in lower edge 23**.

Side panels 14 (the fourth side panel) and side panel 18 (the second side panel) are similarly formed. Panel 14 is connected to panel 12 by fold line 13 and to the fifth panel 20 by fold line 19. Similarly, panel 18 is connected to panel 16 by fold line 17 and to panel 12 by fold line 15. Side panel 14 includes cutouts 21 therein which are similarly shaped to the cutouts 23,27 in panels 12,16 respectively, as is the case of cutouts 25 in side panel 18.

Trapezoidal panel 48 extends upwardly from side panel 18 and is attached thereto by fold line 51. Each of the non-parallel sides of trapezoidal panel 48 includes a slot 49,50 adjacent thereto which extends parallel to the side and receives the foldable tabs from the adjacent trapezoidal panel. Thus, foldable tab 56 from side panel 52 extends into slot 49 when the luminary is erected, and similarly foldable tabs **46*a* from trapezoidal panel 40 extends into slot 50 in trapezoidal panel 48. Likewise, trapezoidal panel 58 is connected to panel 14 by means of fold line 59 and includes a pair of slots 59,60. Slot 59 receives foldable tab 47*a* and slot 60 receives tab 54**.

Figure 5:
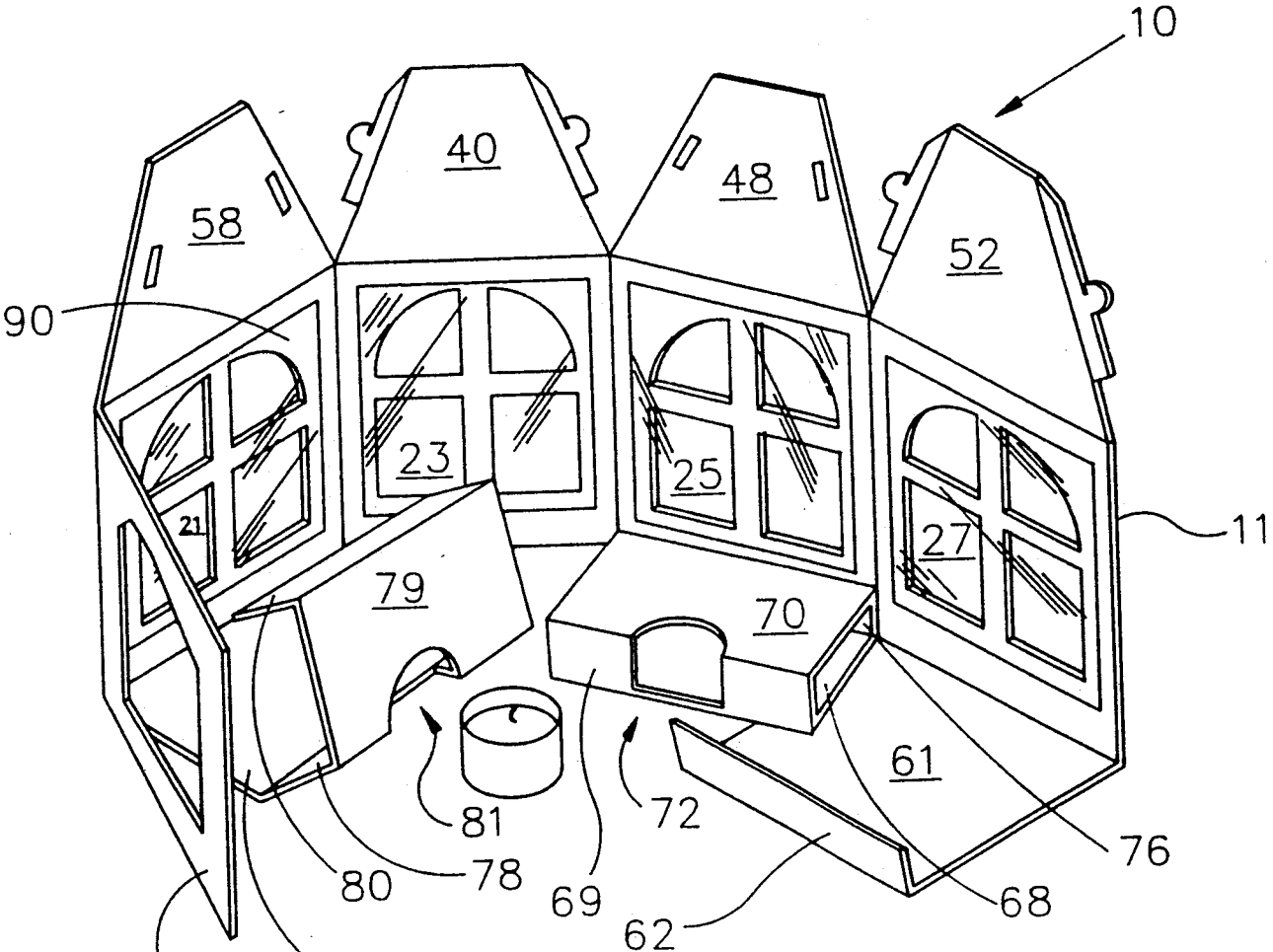
FIG. 5 is a perspective view of the luminary of FIG. 1 in partially formed, partially erected position.

Side panel 14 includes a lower panel 76 extending downwardly therefrom and side panel 18 includes a lower panel 67 extending downwardly therefrom. Each of panels 67,76 are folded, as best illustrated in FIG. 5, to form one-half of the floor 66. Panel 76 includes a plurality of panels 77,78,79,80 connected together by fold lines 82,83,84, respectively. A cutout 81 is formed partially in panel 78 and partially in panel 79 as illustrated in FIG. 4. When folded, as illustrated in FIG. 5, cutout 81 forms half of a circular seat to receive the candle therein.

Lower flap 67 is similarly formed to flap 76 and includes panels 68,69,70,71, joined together by fold lines 73,74,75, respectively. The cutout 72 is identical in shape and function to cutout 81 as previously described.

Finally, the fifth panel 20 is provided which, when erected, is folded and placed inside the first panel 16. This prevents a gap from occurring between the terminal edge 11 of panel 16 and what would otherwise be the terminal edge 19 of panel 14. Cutout 30 is provided in panel 20 which circumscribes or surrounds the entire pattern of cutouts 27 in panel 16.

A sheet of colored, transparent or translucent polymeric film 90 is secured to the inner surface of each of panels 12,14,16,18 and covers the pattern of openings. The material and color is selected depending upon the seasonal design to be displayed. In use, the blanks illustrated in FIG. 4 are marketed to customers in packages containing a plurality of blanks and candles. Each blank is erected to form luminary 10 by making preliminary folds along all fold lines described hereinabove. For purposes of explanation, in the embodiment illustrated and described, all folds are made upwardly from the drawing, assuming FIG. 4 is illustrative of the inner surface of the blank. First, the first, second, third, and fourth panels are folded to form a four-sided object. The fifth panel 20 is folded along fold line 19, and inserted adjacent the inner surface of the first panel 16. The trapezoidal panels 40,48,52,58 are folded along fold lines 41,51,57,59, respectively. The foldable tab panels 43,44,53,55 are then folded to overlie the non-parallel sides of the adjacent panels. Tab 55 of panel 52 is then inserted into slot 49 of trapezoidal panel 48, while tab 54 is inserted into slot 60 of trapezoidal panel 58. Likewise, tab **46*a* of panel 40 is inserted into slot 50 of trapezoidal panel 48 and tab 47*a* is inserted into slot 59 of trapezoidal panel 58**.

Panels 67,76 are then folded to form the half-floor sections and moved to a position adjacent each other with the cutouts 72,81 juxtaposed together. The bottom wall 61 is then folded around the two panels 67,76 and flap 62 is inserted into the gap formed between the side edges of panels 67,76 and the lower edge 23 of panel 12. A candle (not shown) is then inserted into the candle retaining means and the assembly is complete. Formation of the bottom walls can occur either before or after the top panel. The luminary 10 so formed may be used several times. At the end of a holiday season, the blanks may be unfolded and stored, or may be discarded.

A preferred embodiment of the present invention has been shown and described in detail herein-above. While a four-sided luminary is illustrated, the object might have three, five, six, or even more sides. Thus, various changes and modifications might be made from the disclosed embodiment without departing from the scope of the invention which is set forth in the accompanying claims.

What is claimed is:

1. A collapsible holiday luminary, when displayed, having substantially the same silhouette from all sides and comprising:

a. a flat blank of a stiff, foldable, paper or paperboard material divided into a plurality of side panels of substantially equal width, said blank, when folded and the opposite ends are secured together, forms a four-sided object;

b. one end of each of the sides including a trapezoidal panel having a long base and a shorter top extending therefrom, the long base of said trapezoidal panel being substantially the same length as and foldably secured to the adjacent end of the corresponding side and the shorter top connecting with the other panel shorter tops to form a single, horizontally disposed open top;

c. means for attaching said trapezoidal panels together along non-parallel sides;

d. each of said side panels having one or more cutouts therein;

e. the other end of at least one of said side panels including a bottom panel extending therefrom, said bottom panel being substantially the same size and shape as the area enclosed by said side panels and being foldable to form a bottom wall or floor;

f. whereupon said luminary, when erected, includes a floor, cutouts in the side walls, and an open top in the shape of a truncated pyramid, so that said luminary exhibits substantially the same appearance from all sides.

2. The luminary according to claim 1 wherein said means for attaching said trapezoidal panels together comprises:

a. opposite ones of said trapezoidal panels provided with at least one slot adjacent each non-parallel side;

b. opposite others of said trapezoidal panels provided with a foldable tab panel adjacent each non-parallel side;

c. said tab panels being insertable into said slots to form and maintain a top having a truncated, open top, pyramid shape.

3. The luminary according to claim 1 wherein said bottom wall further includes a candle retaining means associated with the inner surface thereof for positioning a candle thereon.

4. The luminary according to claim 3 wherein said candle retaining means includes foldable flaps extending downwardly from opposite ones of said side panels, each of said foldable flaps, when folded, form half of the bottom floor of said luminary, each of said bottom panels including a cutout in the edge adjacent the other bottom panel to form a candle receiving seat therebetween.

5. The luminary according to claim 1 wherein said blank is coated with a moisture-resistant material and the cutouts are covered with a transparent material.

* * * * *